US006766567B2

(12) United States Patent
Karlinski

(10) Patent No.: US 6,766,567 B2
(45) Date of Patent: Jul. 27, 2004

(54) INK JET PRINT HEAD HAVING A POROUS INK SUPPLY LAYER

(75) Inventor: Haggai Karlinski, Ramat Gan (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 10/293,351

(22) Filed: Nov. 14, 2002

(65) Prior Publication Data

US 2003/0088969 A1 May 15, 2003

Related U.S. Application Data

(63) Continuation of application No. 09/330,217, filed on Jun. 11, 1999, now Pat. No. 6,481,074, which is a continuation of application No. 08/276,572, filed on Jul. 18, 1994, now Pat. No. 5,940,099.

(30) Foreign Application Priority Data

Aug. 25, 1993 (IL) ..... 106803

(51) Int. Cl.[7] ..... H04R 17/00; B41J 2/045

(52) U.S. Cl. ..... 29/25.35; 29/830; 29/611; 29/890.1; 347/70

(58) Field of Search ..... 29/25.35, 890.1, 29/830, 611; 427/100; 399/261; 346/140 R, 140 P, 140 PD; 428/336, 135.1, 195, 335, 341, 212; 347/54–72, 20, 44, 47, 27; 310/325, 330, 328

(56) References Cited

U.S. PATENT DOCUMENTS

| | | | | |
|---|---|---|---|---|
| 3,893,215 A | | 7/1975 | Yasar | |
| 4,019,188 A | | 4/1977 | Hochberg et al. | |
| 4,224,627 A | | 9/1980 | Powell et al. | |
| 4,333,087 A | | 6/1982 | Yamaguti | |
| 4,432,003 A | | 2/1984 | Barbero et al. | |
| 4,481,520 A | | 11/1984 | Esaki et al. | |
| 4,611,218 A | | 9/1986 | Sugitani et al. | |
| 4,703,333 A | | 10/1987 | Hubbard | |
| 4,785,313 A | * | 11/1988 | Higuma et al. | 347/105 |
| 4,835,554 A | | 5/1989 | Hoisington et al. | |
| 4,877,680 A | * | 10/1989 | Sakaki et al. | 428/32.3 |
| 4,937,597 A | * | 6/1990 | Yasuhara et al. | 347/71 |
| 4,946,741 A | * | 8/1990 | Aono et al. | 428/32.14 |
| 5,027,131 A | * | 6/1991 | Hasegawa et al. | 347/105 |
| 5,351,375 A | | 10/1994 | Ochiai et al. | |
| 5,610,645 A | | 3/1997 | Moore et al. | |
| 5,653,901 A | | 8/1997 | Yoshimura | |
| 5,906,515 A | | 5/1999 | Yoshimura | |
| 5,940,099 A | | 8/1999 | Karlinski | |
| 6,056,392 A | | 5/2000 | Matsumoto et al. | |

FOREIGN PATENT DOCUMENTS

| | | | | |
|---|---|---|---|---|
| EP | 496490 | | 7/1992 | |
| EP | 572230 | | 12/1993 | |
| EP | 584823 | | 3/1994 | |
| EP | 0 726 151 | | 8/1996 | |
| JP | 56102501 A | * | 8/1981 | B22F/3/24 |
| JP | 66102501 | | 8/1981 | |
| JP | 56-133172 | | 10/1981 | |
| JP | 57176173 | | 10/1982 | |
| JP | 1-46306 | | 2/1989 | |
| JP | 1-208880 | | 8/1989 | |
| JP | 2-225050 | | 9/1990 | |
| JP | 4-37556 | | 2/1992 | |
| JP | 5-185593 | | 7/1993 | |
| JP | 06023988 | | 2/1994 | |
| JP | 6217944 | | 8/1997 | |

* cited by examiner

*Primary Examiner*—Carl J. Arbes
*Assistant Examiner*—Tai V Nguyen
(74) *Attorney, Agent, or Firm*—Eitan, Pearl, Latzer & Cohen Zedek, LLP

(57) ABSTRACT

A liquid droplet ejection device, which includes a number of liquid ejection nozzles, a liquid supply layer including porous material, with the liquid supply layer featuring holes related to the nozzles, and a number of transducers related to the holes for ejecting liquid droplets out through the nozzles.

14 Claims, 5 Drawing Sheets

INK JET PRINT HEAD HAVING A POROUS INK SUPPLY LAYER

CROSS REFERENCE

This application is a continuation application of U.S. application Ser. No. 09/330,217, filed Jun. 11, 1999, now U.S. Pat. No. 6,481,074, issued Nov. 19, 2002, which is a continuation application of U.S. application Ser. No. 08/276,572, filed Jul. 18, 1994, now U.S. Pat. No. 5,940,099, issued Aug. 17, 1999, which claims priority from Israeli Patent Number 106803, filed Aug. 25, 1993.

FIELD AND BACKGROUND OF THE INVENTION

The present invention relates to liquid droplet ejection systems and, more particularly, ink jet system and, even more particularly, to drop-on-demand ink jet systems.

Ink jet systems generally fall into two categories—continuous systems and drop-on-demand systems. Continuous inkjet systems operate by continuously ejecting droplets of ink, some of which are deflected by some suitable means prior to reaching the substrate being imprinted, allowing the undeflected drops to form the desired imprinting pattern. In drop-on-demand systems, drops are produced only when and where needed to help form the desired image on the substrate.

Drop-on-demand ink jet systems can, in turn, be divided into two major categories on the basis of the type of ink driver used. Most systems in use today are of the thermal bubble type wherein the ejection of ink droplets is effected through the boiling of the ink. Other drop-on-demand ink jet systems use piezoelectric crystals which change their planar dimensions in response to an applied voltage and thereby cause the ejection of a drop of ink from an adjoining ink chamber.

Typically, a piezoelectric crystal is bonded to a thin diaphragm which bounds a small chamber or cavity fill of ink or the piezoelectric crystal directly forms the cavity walls. Ink is fed to the chamber through an inlet opening and leaves the chamber through an outlet, typically a nozzle. When a voltage is applied to the piezoelectric crystal, the crystal attempts to change its planar dimensions and, because the crystal is securely connected to the diaphragm, the result is the bending of the diaphragm into the chamber. The bending of the diaphragm effectively reduces the volume of the chamber and causes ink to flow out of the chamber through both the inlet opening and the outlet nozzle. The fluid impedances of the inlet and outlet openings are such that a suitable amount of ink exits the outlet nozzle during the bending of the diaphragm. When the diaphragm returns to its rest position ink is drawn into the chamber so as to refill it so that it is ready to eject the next drop.

Thermal bubble systems, although highly desirable for a variety of applications, suffer from a number of disadvantages relative to piezoelectric crystal systems. For example, the useful life of a thermal bubble system print head is considerably shortened, primarily because of the stresses which are imposed on the resistor protecting layer by the collapsing of bubbles. In addition, because of the inherent nature of the boiling process, it is relatively difficult to precisely control the volume of the drop and its directionality. As a result, the produced dot quality on a substrate may be less than optimal.

Still another drawback of thermal bubble systems is related to the fact that the boiling of the ink is achieved at high temperatures, which calls for the use of inks which can tolerate such elevated temperatures without undergoing either mechanical or chemical degradation. As a result of this limitation, only a relatively small number of ink formulations, generally aqueous inks, can be used in thermal bubble systems.

These disadvantages are not present in piezoelectric crystal drivers, primarily because piezoelectric crystal drivers are not required to operate at elevated temperatures. Thus, piezoelectric crystal drivers are not subjected to large heat-induced stresses. For the same reason, piezoelectric crystal drivers can accommodate a much wider selection of inks. Furthermore, the shape, timing and duration of the ink driving pulse is more easily controlled. Finally, the operational life of a piezoelectric crystal driver, and hence of the print head, is much longer. The increased useful life of the piezoelectric crystal print head, as compared to the corresponding thermal bubble device, makes it more suitable for large, stationary and heavily used print heads.

Piezoelectric crystal drop-on-demand print heads have been the subject of much technological development. Some illustrative examples of such developments include U.S. Pat. Nos. 5,087,930 and 4,730,197, which are incorporated by reference in their entirety as if fully set forth herein and which disclose a construction having a series of stainless steel layers. The layers are of various thicknesses and include various openings and channels. The various layers are stacked and bonded together to form a suitable fluid inlet channel, pressure cavity, fluid outlet channel and orifice plate.

The systems disclosed in the above-referenced patents illustrate the use of a fluid inlet channel having a very small aperture, typically, 100 microns or less. The use of a very small aperture is dictated by the desirability of limiting the backflow from the ink cavity during. ejection of a drop but is problematic in that the small aperture is susceptible to clogging during the bonding of layers as well as during normal operation of the print head.

The construction disclosed in the above-referenced patents requires the very accurate alignment of the various layers during manufacture, especially in the vicinity of the small apertures which form portions of the fluid path. Furthermore, the openings in the orifice plate which form the outlets of the various flow channels have sharp edges which could have adverse effects on the fluid mechanics of the system.

Additionally, the techniques used in forming the openings in the orifice plate, which typically include punching, chemical etching or laser drilling, require that the thickness of the orifice plate be equal to, or less than, the orifice diameter which is itself limited by resolution considerations to about 50 microns.

Finally, any air bubbles trapped inside the flow channel cannot easily be purged and, because the bubbles are compressible, their presence in the system can have detrimental effects on system performance.

SUMMARY OF THE INVENTION

According to the present invention there is provided a liquid droplet ejection device, comprising: (a) a plurality of liquid ejection nozzles; (b) a liquid supply layer including porous material, the liquid supply layer featuring holes related to the nozzles; and (c) a plurality of transducers related to the holes for ejecting liquid droplets out through the nozzles.

In some embodiments of devices according to the present invention, the porous material includes sintered material, such as, sintered stainless steel.

According to one embodiment of the present invention, the transducers are piezoelectric elements, the nozzles are the outlets of capillaries and the device further comprises: (d) a deflection plate, the piezoelectric elements being connected to the deflection plate; and (e) a liquid cavity layer formed with cutouts therethrough, the cutouts being related to the piezoelectric elements, the liquid cavity layer adjoining the deflection plate, the liquid cavity layer adjoining the liquid supply layer, the holes of the liquid supply layer being related to the cutouts, the capillaries located in the holes, the liquid supply layer being configured so that liquid is able to flow from the porous material into the cutouts.

According to another embodiment of the present invention, the liquid cavity layer is omitted and the deflection layer directly adjoins the liquid supply layer.

According to yet other embodiments of the present invention, the nozzles are formed by an orifice plate which adjoins the liquid supply layer, which may, in turn, adjoins the deflection plate or the liquid cavity layer, when present.

According to other embodiments of the present invention, the transducers are heat elements and droplet ejection is effected by the thermal bubble method, rather than through the use of piezoelectric elements.

The ejection of ink drops using a device according to one embodiment of the present invention is accomplished as follows: A pressure pulse is imparted to a volume of ink in an ink cavity through the deflection of a thin deflection plate, or diaphragm, located on top of the ink cavity. The plate is deflected downward by the action of a piezoceramic crystal whenever a voltage is applied across its electrodes, one of which is in electrical contact with the usually metallic deflection plate.

The pressure pulse created by the downward bending of the deflection plate drives the ink towards and through an outlet, preferably a glass capillary having a convergent nozzle at its outlet end, causing the ejection of a drop of a specific size.

When the piezoelectric crystal is de-energized, it returns to its equilibrium position, reducing the pressure in the ink cavity and causing the meniscus at the outlet end of the glass capillary to retract.

The retracted meniscus generates a capillary force in the glass capillary which acts to pull ink from an ink reservoir into the ink cavity and into the glass capillary. The refilling process ends when the meniscus regains its equilibrium position.

In alternative embodiments of devices of the present invention there are provided systems similar to those presented above but which, instead of relying on piezoelectric elements and a deflecting plate, features heating elements which serve to boil the ink, thereby causing its ejection.

A key element in print heads according to the present invention is the presence of porous material which is in hydraulic communication with both the ink reservoir and the individual ink cavities. Preferably, the glass capillaries are embedded in openings in the porous material. The porous material preferably also defines part of the walls of the ink cavities.

Proper selection of the porous material makes it useful as a filter, serving to prevent any foreign particles which may be present in the ink from reaching the nozzles and possibly blocking them.

It will be readily appreciated that in order to achieve high drop ejection rates, the time required to refill the ink cavity following ejection of a drop must be as short as possible. The refilling time can be reduced by reducing the restriction to flow into the ink cavity. However, reduction of the restriction to inflow tends to increase the adverse effects of cross talk, i.e., the undesired interactions between separate ink cavities.

The optimization of the system in terms of the conflicting requirements of low cross talk and high refill rate can be effected through the judicious selection of a porous material having optimal characteristics for the intended application, taking into account, in addition, the viscosity of the ink and the nozzle geometry. The important characteristics of the porous material include the pore size and the permeability to flow (together referred to as "micron grade"), as well as the macro and micro geometries of the porous material.

As stated above, the optimal balance between the in-flow of ink into the ink cavity and its out-flow from the cavity is also affected by the ink viscosity and nozzle dimensions. The lower the viscosity of the ink, the faster is the refilling rate of the ink cavity but the more pronounced is the cross talk between separate cavities. Also, the smaller the outlet nozzle diameter, the more pronounced is the capillary action of the nozzle and hence, the higher is the refilling rate.

Ink jet print heads are generally designed so that the dimensions of the ink channels into and out of the ink cavity are such that the channels have acoustic impedances which are optimal for a specific ink of a given viscosity and for a specific nozzle diameter. If it is desired to use a print head with a different nozzle diameter and/or with a different viscosity ink, the print head channels must be redesigned to accommodate the new nozzle diameter and/or different viscosity ink.

By contrast, use of a porous material according to the present invention, makes it possible to preserve the same print head geometry and structure even when ink of a different viscosity and/or when a different nozzle geometry are to be used. The optimization of the acoustic impedances of the channels can be effected merely through the proper selection of a suitable porous material having suitable characteristics, such as a suitable micron grade.

Apart from the ability to optimize the print head without the need to redesign the flow channels, use of porous materials according to the present invention eliminates the small, and easily clogged, ink inlet apertures leading to the ink cavities.

Still another advantage offered by the use of the porous material according to the present invention is the material's ability to act as a filter, thereby reducing, or even completely obviating, the need for special filtration of the in-flowing ink.

Finally, the fabrication of print heads including porous material according to the present invention can be effected using simple production techniques without the need for complex and expensive micro-machining.

BRIEF DESCRIPTION OF THE DRAWINGS

The invention is herein described, by way of example only, with reference to the accompanying drawings, wherein.

Figure 1:
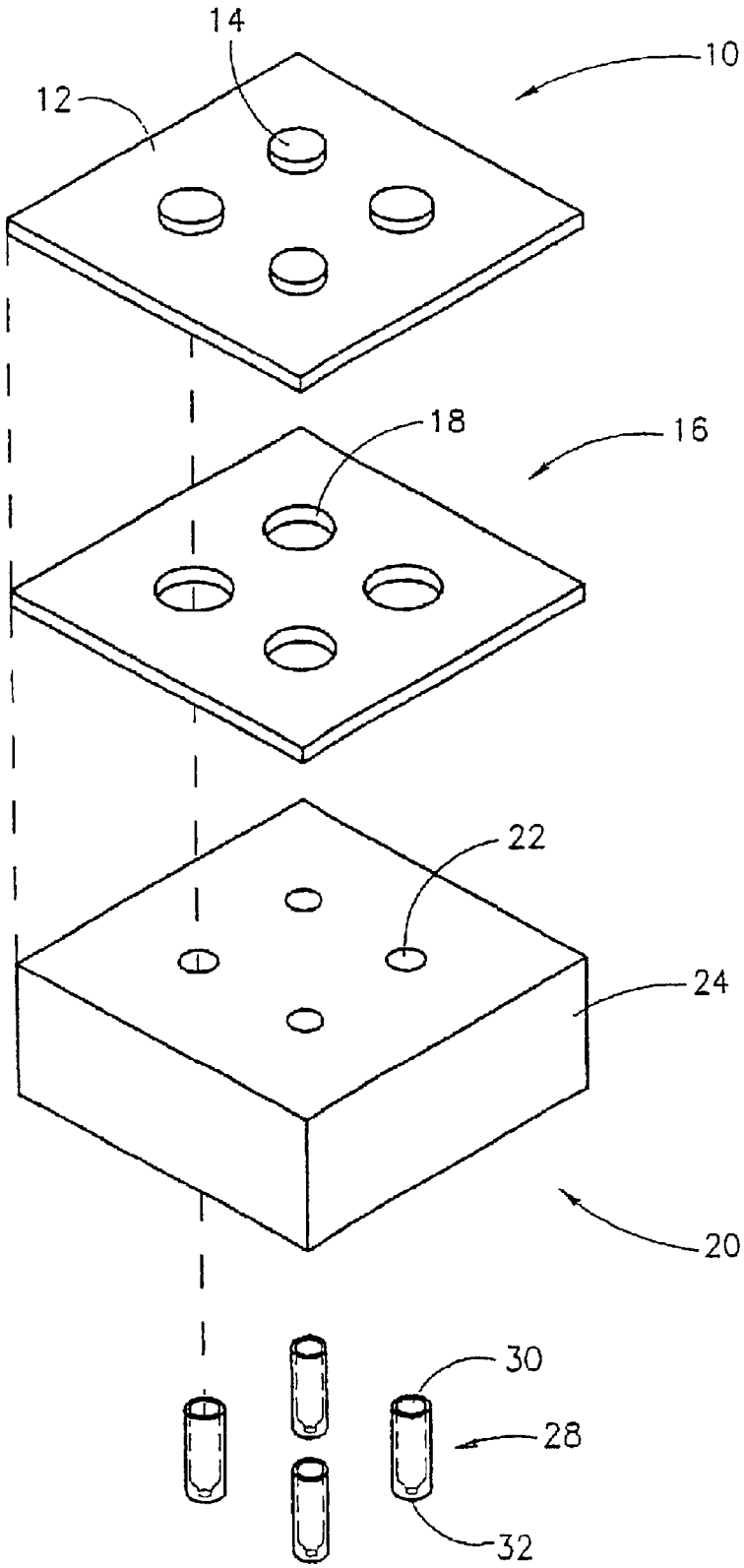
FIG. 1 is an exploded perspective view of an ink jet print head of the piezoelectric element type according to a preferred embodiment of the present invention.
Figure 4:
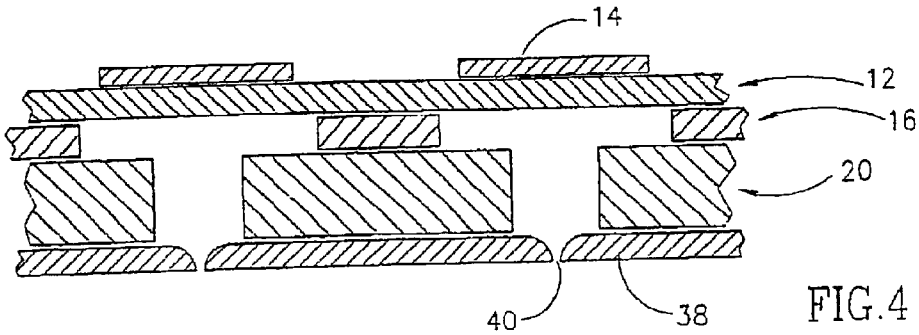
Figure 3:
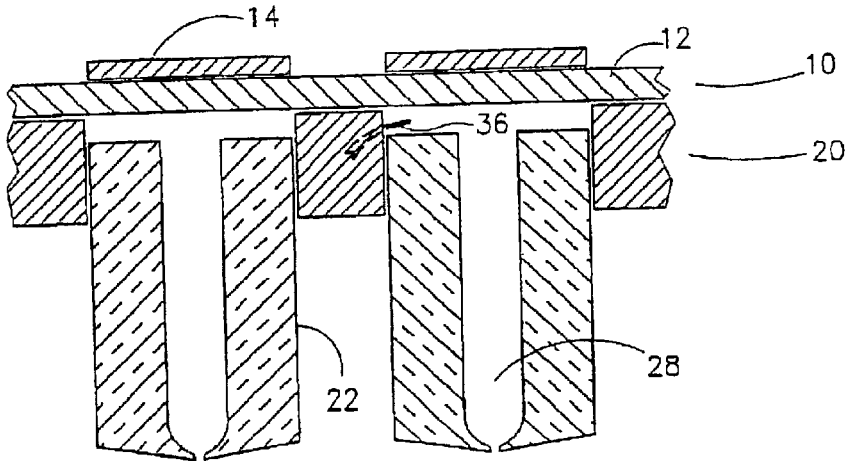
Figure 4A:
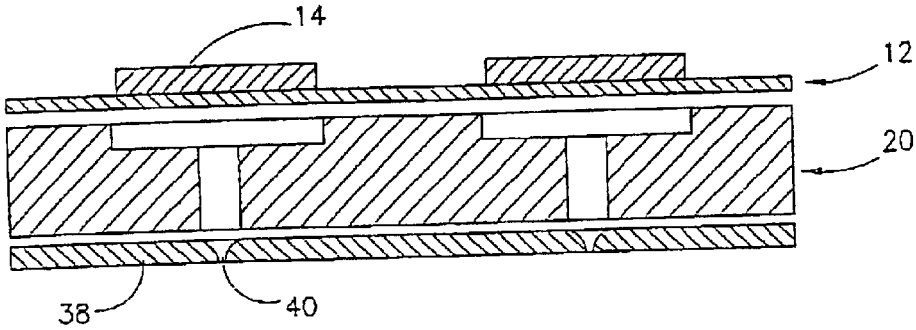
Figure 5:
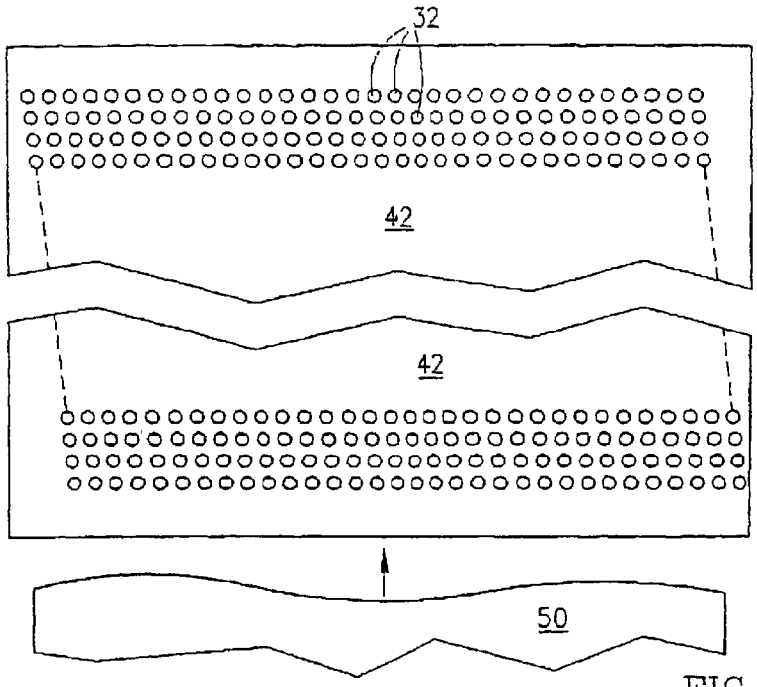
Figure 7:
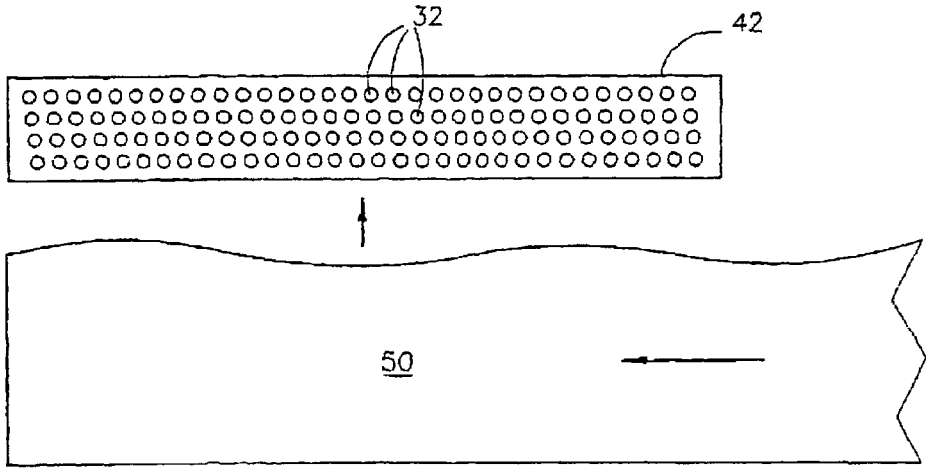
Figure 6:
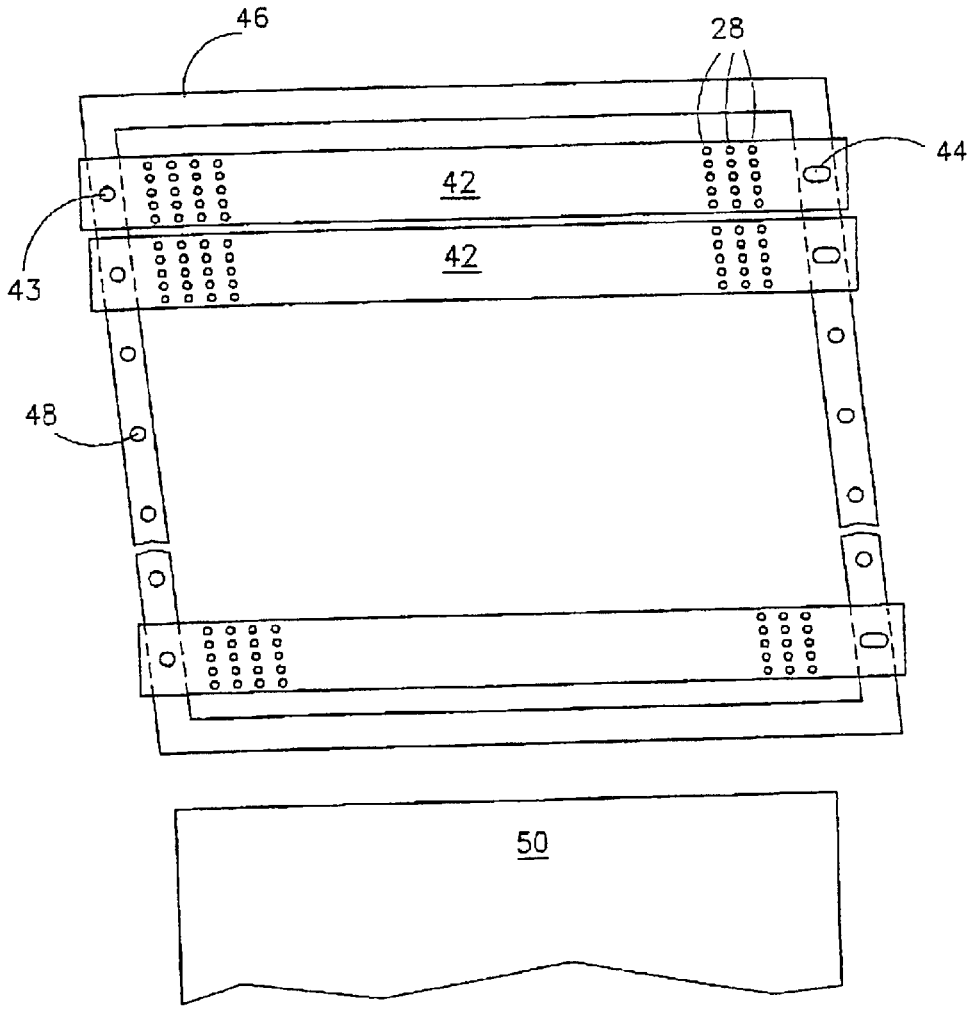

FIG. 3 is an assembled side cross-sectional view of another embodiment of an ink jet print head similar to the embodiment of FIG. 1 but without the ink cavity layer;

FIG. 4 is an assembled side cross-sectional view of yet another embodiment of an ink jet print head according to the present invention similar to the embodiment of FIG. 1 but using an orifice plate instead of glass capillaries;

FIG. 4A is an assembled side cross-sectional view of an embodiment as in FIG. 4 but without an ink cavity layer;

FIG. 5 is a schematic depiction of a skewed arrangement of nozzles in a multi-nozzle print head;

FIG. 6 is a partial plan view of a number of print heads according to the present invention assembled on a frame;

FIG. 7 is a schematic depiction of a printer with two-dimensional motion wherein both the print head and the substrate move.

DETAILED DESCRIPTION OF THE PRESENT INVENTION

The present invention is of an ink jet print head which can replace conventional print heads and which has improved properties as described herein.

Although the description throughout is largely related to systems for ejecting drops of ink for purposes of printing, it will readily be appreciated that systems and methods according to the present invention are not limited to the ejection of ink and that such systems and methods are also suitable for the ejection of a large variety of incompressible fluids, or liquids. It is intended that the applications systems according to the present invention to all of these liquids be included within the scope of the present invention. The description of the present invention, which is largely confined to ink jet printing applications is illustrative only, and is not intended to limit the scope of the present invention. It is believed that systems according to the present invention can be usefully applied to eject droplets of a variety of incompressible fluids having a surface tension greater than about 40 dynes/cm and a viscosity lower than about 50 cps.

The principles and operation of a print head according to the present invention may be better understood with reference to the drawings and the accompanying description.

Figure 2:
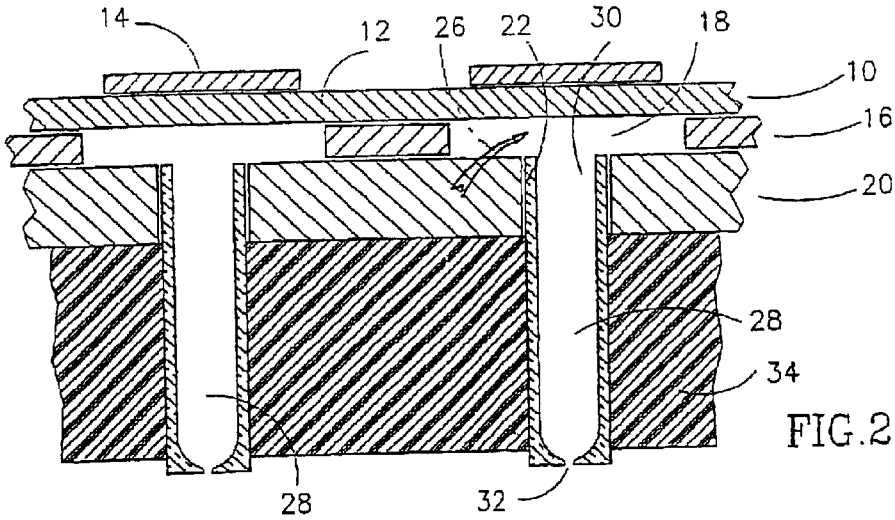
FIG. 2 is an assembled side cross-sectional view of the print head of FIG. 1.

Referring now to the drawings, FIGS. 1 and 2 illustrate the structure of an embodiment of a print head according to the present invention in exploded perspective view and in assembled side cross-sectional view, respectively.

The structure of the embodiment of the print head includes three layers, an activation layer 10, an ink cavity layer 16 and an ink supply layer 20.

Activation layer 10 includes a diaphragm, or deflection plate 12, which may be made of any suitable material, including, but not limited to, stainless steel. Connected to the upper surface of deflection plate 12 are transducers, which are preferably piezoceramic elements, most preferably disk-shaped. The term 'transducer' is used herein to designate any mechanism which uses force or energy to cause a drop to eject, including, but not limited to piezoelectric elements and heating elements, as in the thermal bubble method described below, among others. For illustrative purposes, four piezoelectric elements 14 are shown in FIG. 1 but any convenient number may be used.

Deflection plate 12 is preferably made of stainless steel and is approximately 50 microns in thickness. Other materials, such as glass or alumina can be used, provided that the surface of deflection plate 12 to which the piezoelectric elements are bonded is an electrical conductor. This can be achieved by metallizing the surface, for example, through the use of nickel, gold or silver electrodes on both faces of piezoelectric elements 14, which can then be readily bonded to the upper surface of deflection plate 12 by means of a thin layer of electrically conductive epoxy.

The range of suitable plate thicknesses is believed to be from about 30 to about 100 microns, depending on the specific material selected for the plate and its modulus of elasticity.

While piezoceramic elements 14, typically made of PZT material, are, preferably, disk-shaped, they may be of other shapes, including, but not limited to, square, rectangular or octagonal. Disk-shaped piezoelectric elements are believed to be superior to their square or rectangular equivalents with regard to the efficiency of the transducer. The manufacturing cost of disc-shaped piezoelectric elements is, however, relatively high and requires the positioning of discrete elements on the deflection plate. The thickness of the piezoelectric elements is preferably from about 2 to about 2.5 times the thickness of deflection plate 12.

The cost of the piezoelectric elements can be reduced without significant adverse effect on performance by first bonding a large piezoelectric sheet to deflection plate 12 and subsequently cutting the sheet into, for example, octagons by means of a diamond saw, a laser or selective chemical etching.

The diameter, or effective diameter, of the circular, or octagonal, piezoelectric element is preferably approximately 2 mm. Larger diameters can be used, subject to the limitation imposed by the maximum distance between adjacent ejection nozzles in the overall design of the print head.

Ink cavity layer 16, preferably made of stainless steel sheet or of a polymer, such as polyimide, is located below activation layer 10. Ink cavity layer 16 is formed with cutouts 18, preferably circular, which are each aligned with a corresponding piezoelectric element 14 and each of which forms a separate ink cavity when the top surface of ink cavity layer 16 is bonded (FIG. 2) to the bottom surface of activation layer 10 and to the top surface of ink supply layer 20.

Ink cavity layer 16 is preferably fabricated of stainless steel plate and preferably has a thickness of approximately 200 microns. The cross sectional area of cutouts 18, is preferably about 10% larger than the cross sectional area of piezoelectric elements 14, such as the PZT elements. A typical diameter of cutouts 18 might be approximately 2.2 mm.

Cutouts 18, can be formed by various means, including, but not limited to, punching, laser cutting, EDM, chemical etching and chilling.

The ink cavities formed by cutouts 18 can be of any shape, such as, for example, square or circular, but should preferably be of the same shape as piezoelectric element 14 while having a cross-sectional area which is about 10% larger than that of piezoelectric element 14, as described above.

Ink cavity layer 16 may be bonded to deflection plate 12 in any suitable manner including, but not limited to, by means of epoxy adhesive or by brazing.

The thickness of ink cavity layer 16 defines the height of the ink cavities and, along with the size and shape of cutouts 18, determines the volume of the ink cavities. Preferably, the volume of the ink cavities should be kept small in order to achieve significant pressure rises in the ink inside the cavity whenever deflection plate 12 bends downwards into the ink cavity.

The thickness of ink cavity layer 16 should preferably range from about 100 to about 200 microns.

Ink cavity layer 16 may alternatively be formed from an adhesive film or plate having a thickness as described above and having cutouts 18 which have been created in the layer through drilling or photoforming.

Ink cavity layer 16 is bonded on its lower surface to ink supply layer 20 which includes suitable porous material. Any suitable porous material may be used. Preferably, the porous material is a sintered material, most preferably, stainless steel porous plate of suitable characteristics. Sintered stainless steel is available from a number of suppliers, for example, from Mott Metallurgical Corp. of Connecticut, U.S.A., and comes in a variety of sheet sizes, thicknesses and micron grades.

Ink supply layer 20 is formed with holes 22 which extend continuously between the top and bottom surfaces of ink supply layer 20, each hole 22 of ink supply layer 20 being associated with a particular circular cutout of ink cavity layer 16. Holes 22 are smaller than cutouts 18, allowing ink which enters porous ink supply layer 20 from an ink reservoir (not shown), for example, through its face 24, to flow through the top surface of ink supply layer 20 into the ink cavities, as indicated by an arrow 26 (FIG. 2).

The centerlines of holes 22 in ink supply layer 20 and cutouts 18 in ink cavity layer 16 are preferably aligned.

Ink supply layer 20 has a thickness which preferably ranges from about 0.5 mm to several mm.

Holes 22, which are preferably approximately 800 microns in diameter, are used to hold the glass capillaries, which are described below. Holes 22 can be made by any suitable technique including, but not limited to, machining by EDM, drilling by conventional means or drilling by laser.

In one embodiment of the present invention, the porous material provides the structure which holds the glass capillaries 28 in place. As a result, the spacing of holes 22 and their diameters should be machined using close tolerances. EDM machining can provide tolerances as small as 0.005 mm while conventional drilling techniques give tolerances which can be as low as 0.01 mm.

The upper surface of porous ink supply layer 20 is preferably bonded to the lower surface of ink cavity layer 16 using epoxy of high viscosity or using dry epoxy film adhesive having suitably located holes. In the latter case, the holes in the dry epoxy film adhesive should be somewhat larger than cutouts 18 so as to prevent any adhesive from covering the open pores of the porous material in the cavity, e.g., in the region of arrow 26 (FIG. 2). Other methods such as, for example, brazing or diffusion bonding can be used provided that the bonding material does not penetrate the porous material, for example, by wicking action.

The porous material which makes up ink supply layer 20 preferably serves multiple functions:

(a) The porous material allows ink to flow from an ink reservoir, preferably through one or more of the side, top or bottom faces of the porous material, to the various separate ink cavities, preferably through the top faces of the ink cavities, as indicated by arrow 26 (FIG. 2), but the actual flow patterns will depend on the precise configuration;

(b) The porous material filters the ink throughout the ink's travel from the inlet portion of the porous medium at the ink reservoir and until the ink leaves the porous medium to enter an ink cavity;

(c) The porous material provides optimized acoustic impedances to optimize system performance, as discussed above;

(d) The porous medium provides a structure or a substrate in which the capillaries are properly mounted or held.

As will be readily appreciated, the micron grade and the surface area of the porous material which is open for flow into the ink cavity has a crucial impact on the refill time of the ink cavities and hence on the maximum drop ejection rate, or frequency.

For example, for an open area of 4.2 $mm^2$ and a porous material of 0.5 micron grade, the maximum ejection frequency was found experimentally to be about 2 kHz for 100 picoliter drops of a fluid having a viscosity of 1 cps. Using a 0.8 micron grade porous material and the same fluid and drop volume, the maximum ejection frequency was found to be about 4 kHz.

Connected to each hole 22 in ink supply layer 20 in some suitable fashion is an appropriate capillary 28, preferably a glass capillary, which includes a straight capillary tube having a capillary inlet 30, and a capillary outlet, or nozzle 32. Preferably, capillary 28 is a converging capillary having a diameter of approximately 50 microns near its outlet, or nozzle 32 where drops are ejected.

Preferably, glass capillaries 28 are inserted into holes 22 of the porous ink supply layer 20, in such a way that capillary inlet 30 is flush with the upper surface of ink supply layer 20 while capillary outlet 32 protrudes beyond the lower surface of ink supply layer 20. An epoxy adhesive layer 34, or similar material, may be used to fill in the space below ink supply layer 20 and between capillaries 28 and serves to hold glass capillaries 28 in place and to seal the lower surface of ink supply layer 20.

Capillaries 28 are preferably glass capillaries made of quartz or borosilicate capillary tubes. The tubes in the preferred embodiment have an outer diameter of about 800±5 $\mu$m and an inner diameter of about 500±5 microns. A converging nozzle 32 is formed at end of capillary 28. The fabrication of capillary 28 can be effected in various suitable ways. Preferably, the fabrication is accomplished by rotating the capillary while simultaneously heating it using, for example, a discharge arc or a laser beam targeted at a suitable location on the capillary. The heating serves to lower the viscosity of the glass. As the viscosity of the glass falls below a certain lower limit, the inner walls of the capillary at the location of heating begin to flow and converge radially inward, forming a narrow throat. The diameter of the throat of capillary 28, as well as the geometry of the converging section, can be precisely controlled through control of the glass temperature and the duration of the heating. For applications in a print head having a resolution of 300 dots per inch (dpi), the throat diameter is preferably about 50 microns. Much smaller diameters can be achieved with the above method and may be desirable for certain applications.

Cutting the glass at the throat can be achieved using a high power laser beam which yields a clean polished surface. It is also possible to cut the capillary at the throat by a diamond saw and then polish the cut surface. The inlet end of the capillary may be cut in a similar manner.

To complete the fabrication, glass capillaries 28 are inserted into holes 22, with their inlets 30 being flush with the upper surface of porous ink supply layer 20.

Figure 2A:
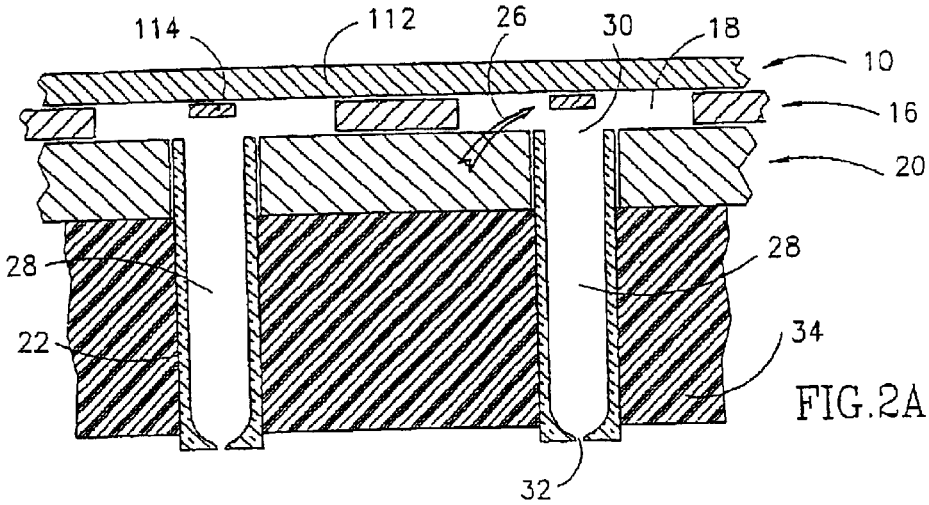
FIG. 2A is an assembled side cross-sectional view of an alternative print head similar to the embodiment of FIG. 1 but using the thermal bubble type featuring heating elements connected to the lower surface of the top plate.

In an alternative embodiment, shown in FIG. 2A, the device is similar to that shown in FIGS. 1 and 2, except for the elimination of piezoelectric elements 14 and their replacement by a plurality of heating elements 114, which are used to boil the ink in the ink cavities producing the high pressure which causes its ejection, i.e., using the thermal bubble technique described above. Heating elements 114 are situated so as to be able to heat the ink located in the ink cavity, preferably connected to the lower surface of a top plate 112, which is no longer flexible as was the case with deflection plate 12 (FIGS. 1 and 2). Preferably, heating elements 114 are suitably coated so as to eliminate the adverse effects of chemical and physical attack by the hot ink. Having illustrated the possibility of applying systems according to the present invention in the context of a thermal bubble system, the rest of the description will be confined, for purposes of illustration, to descriptions of additional embodiments of piezoelectric element systems, it being understood, that corresponding thermal bubble systems are also possible and are intended to fall within the scope of the present invention.

Shown in FIG. 3 is another embodiment of the present invention similar to that of FIGS. 1 and 2 but wherein ink cavity layer 16 (FIGS. 1 and 2) has been eliminated and ink cavities have been provided in an alternative manner, as described below.

In the embodiment of FIG. 3, ink supply layer 20, includes porous material and features holes 22 of a diameter which is about 10% larger than the diameter of piezoelectric elements 14 and is typically in the range of from about 2 to about 2.5 mm. The centerlines of holes 22 are preferably aligned with those of piezoelectric elements 14. Glass capillaries 28 have an outer diameter which is slightly smaller than the diameter of holes 22 with their centerlines being aligned with the centerlines of piezoelectric elements 14 and holes 22.

Holes 22 are machined in such a way as to keep open the pores at the circumference of porous ink supply layer 20 which border on the upper portion of holes 22. This allows ink to flow from the porous material into the ink cavities, as is described below.

Glass capillaries 28, with outer diameter slightly smaller than the diameter of holes 22, are inserted into holes 22. Unlike the embodiment of FIGS. 1 and 2, wherein inlets 30 of capillaries 28 are placed so as to be flush with the upper surface of ink supply layer 20, in the embodiment of FIG. 3 inlets 30 of capillaries 28 are positioned so as to be somewhat below the plane of the top surface of ink supply layer 20, thereby forming ink cavities which are bounded by deflection plate 12 on top, by capillary 28 at the bottom and by inner walls of holes 22 in porous ink supply layer 20 on the sides.

The ink moves from porous ink supply layer 20 and enters the ink cavity as shown by the dashed arrow 36 (FIG. 3). The total area available for flow of ink during the refilling of the ink cavity following drop ejection can be calculated by multiplying the circumference of the ink cavity by its height. Again, as described in the preferred embodiment, the open area and the micron grade of the porous material is selected to provide optimal fluid impedances and system performance.

A third embodiment of the present invention is depicted in FIG. 4. Here the structure of the print head is similar to that described in the preferred embodiment (FIGS. 1 and 2). However, glass capillaries 28 of FIGS. 1 and 2 have been replaced by an orifice plate 38 having a series of orifices 40.

Orifice plate 38 with orifices 40 can be formed using any suitable material, for example, a thin sheet of glass, such as a fused silica sheet having a thickness in the range of from about 0.1 to about 1 mm. Each of orifices 40 can be formed by using a short pulse of a properly directed laser beam of an appropriate type. Through proper selection of beam intensity, diameter and pulse duration, an opening of approximately 50 microns can be formed with a bell mouth shape with the larger diameter opening on the side of the glass nearer the laser source. Preferably, the glass sheet is first bonded to the lower surface of ink supply layer 20 with orifices 40 being created after the bonding. Since the holes in ink supply layer 20 are much larger than the diameter of the laser beam, the formation of orifices 40 can readily be performed after the bonding of the glass sheet to ink supply layer 20 without adversely affecting the holes of ink supply layer 20. Creating orifices 40 after the bonding of the glass sheet to ink supply layer 20 allows for the very precise location and spacing of orifices 40.

Orifice plate 38 with orifices 40, which are typically approximately 50 microns in diameter, can alternatively be formed by various other techniques including, but not limited to, electroplating.

Orifice plate 38 is bonded to the porous ink supply layer 20 in such a way that the centerlines of orifices 40 are aligned with corresponding holes 22 in porous ink supply layer 20.

A fourth embodiment of the present invention is shown in FIG. 4A. Here, as in the embodiment of FIG. 4, orifice plate 38 is used but, unlike the embodiment of FIG. 4 and similar to the embodiment of FIG. 3, ink cavity layer 16 has been eliminated and ink cavities have been provided in an alternative maimer, as described above in the context of the embodiment of FIG. 3.

Reference is now made to FIG. 5, which is a partial view from the paper side of a multi-nozzle print head. Shown in FIG. 5 is an arrangement of nozzles 32 laid out as an array made up of horizontal rows which are horizontally staggered, or skewed, with respect to one another. The print head preferably extends the full width of the paper. Writing over the full area of the paper is achieved by effecting relative vertical motion between the head and the paper 50. For example, the print head may be stationary while the paper moves vertically.

The timing of the ejection of drops from any one row relative to any other row is made to be equal to the time of paper travel between such rows. Thus, for example, in order to write a solid horizontal line at a given vertical position on the paper, each row of nozzles is made to eject an ink drop when the given paper position passes opposite that row.

The extent of stagger between the various rows is such that, as the paper moves, the traces of ink drops from the various nozzles define non-overlapping, essentially equally spaced parallel lines. The spacing of these lines determines the effective horizontal resolution of the head.

The minimal distance between adjacent nozzles is determined by the maximum dimensions of the ink cavity of the transducer. This distance is typically ⅛ of an inch. Thus, the nozzles may be horizontally spaced, for example, 7.5 per inch. In order to achieve an effective horizontal resolution of 300 dots per inch, which is typical for a high quality printer, the total number of nozzles must, in this example, be 40 times that in a single row. Therefore, 40 mutually staggered rows are required in the complete head.

For reasons of efficient manufacturing and servicing, it is preferable to divide the print head horizontally or vertically into several identical sections, or modules 42. FIG. 6 schematically shows an example of a head constructed out of such vertically adjacent modules 42. A rigid frame 46 has along its sides a pair of registration pins 48 for each module. Pins 48 engage a hole 43 and a slot 44 at corresponding ends of module 42. The horizontal positions of pins 48 are such as to locate each module 42 at its proper staggered position.

It will be appreciated that with a head, such as described above, printing at full resolution simultaneously across the full width of the paper, the achievable printing rate, in terms of pages per minute, can be relatively high—much higher than state-of-the-art drop-on-demand printers and comparable to presently available commercial laser printers. If a lower printing rate is sufficient, then a proportionately smaller head (i.e., one with fewer nozzles) may be utilized, but then two-dimensional motion between the head and the paper is necessary.

All embodiment of a printer with a two-dimensional motion is shown schematically in FIG. 7. The head extends the full height of paper 50 and includes an array of a few, say, four, vertical rows which are vertically staggered so as to define equally spaced horizontal lines. The head moves repeatedly across the paper, ejecting ink drops along the horizontal lines. After each such crossing the paper moves vertically one resolution unit, so that the next set of horizontal ink traces is immediately adjacent the previous one. This process continues until the full interline space has been covered with traces. If, for example, each row has 7.5 nozzles per inch, the four rows define 30 lines per inch, spaced 1/30 inch apart. It then takes ten passes of the head, with the paper moving 1/300 inch at a time, to cover the entire page area. Such a printer may still be faster than the state-of-the-art drop-on-demand printers.

While the invention has been described with respect to a limited number of embodiments, it will be appreciated that many variations, modifications and other applications of the invention may be made, all of which are intended to fall within the scope of the present invention.

What is claimed is:

1. An ink-jet printing head comprising:

a porous ink supply layer to receive ink from an ink reservoir, said porous layer is a continuous porous medium having a plurality of pores therein and a plurality of holes, each of said holes extending between a top surface and a bottom surface of said ink supply layer;

a plurality of ink cavities to receive ink from part of said pores, each of said cavities generally aligned with one end of a corresponding hole in said porous medium; and a plurality of nozzles, each of said nozzles generally aligned with an opposite end of said corresponding hole.

2. The printing head of claim 1 further comprising a plurality of transducers, wherein each of said transducers effects ink droplet ejection from one of said nozzles.

3. The printing head of claim 2, wherein said transducers are piezoelectric transducers.

4. The printing head of claim 1, wherein the structure of said porous medium facilitates flow of said ink into said ink cavities prior to said droplet ejection.

5. The printing head of claim 1, wherein the structure of said porous medium enables flow of said ink out of said ink cavities to dissipate inside said porous medium.

6. The printing head of claim 1, wherein said porous medium filters said ink such that foreign particles present in said ink are prevented from reaching said nozzles.

7. The printing head of claim 1, wherein said porous medium comprises sintered material.

8. The printing head of claim 1, wherein said nozzles are formed as an array.

9. The printing head of claim 1, wherein said nozzles are formed as a staggered two dimensional array.

10. The printing head of claim 2, wherein said ink cavities are openings within a cavity plate disposed between said porous medium and an activation layer, said activation layer comprising said transducers, each of said openings is larger than said corresponding hole.

11. The printing head of claim 1, wherein said porous medium forms the walls of said cavities.

12. The printing head of claim 1, wherein said nozzles are orifices within a nozzle plate disposed adjacent to said porous medium, each of said orifices is smaller than said corresponding hole.

13. The printing head of claim 10, wherein said porous medium is substantially thicker than said cavity plate.

14. The printing head of claim 12, wherein said porous medium is substantially thicker than said nozzle plate.

* * * * *